US005198864A

United States Patent [19]

Fletcher

[11] Patent Number: 5,198,864

[45] Date of Patent: Mar. 30, 1993

[54] TRANSFER SYSTEM WITH FIELD TAILORING

[75] Inventor: Gerald M. Fletcher, Pittsford, N.Y.

[73] Assignee: Xerox Corporation, Stamford, Conn.

[21] Appl. No.: 812,276

[22] Filed: Dec. 23, 1991

[51] Int. Cl.[5] ..... G03G 15/16

[52] U.S. Cl. ..... 355/274; 355/273; 355/315

[58] Field of Search ..... 355/271, 273, 274, 275, 355/312, 315

[56] References Cited

U.S. PATENT DOCUMENTS

| | | | |
|---|---|---|---|
| 3,830,589 | 8/1974 | Allen | 355/274 |
| 3,850,519 | 11/1974 | Weikel, Jr. | 355/274 |
| 3,924,943 | 12/1975 | Fletcher | 355/274 |
| 3,976,370 | 8/1976 | Goel et al. | 355/315 |
| 4,014,605 | 3/1977 | Fletcher | 355/273 |
| 4,055,380 | 10/1977 | Borostyan | 355/273 |
| 4,338,017 | 7/1982 | Nishikawa | 355/272 |
| 4,823,158 | 4/1989 | Casey et al. | 355/274 |
| 4,849,784 | 7/1989 | Blanchet-Fincher et al. | 355/274 |

FOREIGN PATENT DOCUMENTS

| | | | |
|---|---|---|---|
| 3104212 | 12/1981 | Fed. Rep. of Germany . | |
| 55-29851 | 3/1980 | Japan . | |
| 0191670 | 11/1982 | Japan | 355/315 |
| 60-57860 | 4/1985 | Japan . | |
| 60-10983 | 8/1986 | Japan . | |
| 0284783 | 12/1986 | Japan | 355/271 |
| 0134675 | 6/1987 | Japan | 355/274 |
| 0184775 | 7/1988 | Japan | 355/274 |

*Primary Examiner*—A. T. Grimley
*Assistant Examiner*—J. E. Barlow, Jr.
*Attorney, Agent, or Firm*—Denis A. Robitaille

[57] ABSTRACT

A system for tailoring electrostatic fields in and around a transfer region in an electrostatographic printing apparatus. The system includes a toner transfer system for transferring charged toner particles from an imaging surface to a copy sheet and a transfer nip and a conductive pre-nip sheet guide member, as well as a conductive post-nip sheet guide member, wherein each sheet guide member is coupled to a biasing source. The pre-nip sheet guide member is biased to a polarity similar to the polarity of the charged toner while the post-nip sheet guide member is biased to a polarity opposite the polarity of the charged toner particles. The invention provides for efficient and effective toner transfer while suppressing the effects of lateral condition of transfer biases through the copy sheet under high relative humidity conditions.

24 Claims, 6 Drawing Sheets

TRANSFER SYSTEM WITH FIELD TAILORING

The present invention relates generally to a system for transfer of charged toner particles in an electrostatographic printing apparatus, and more particularly concerns a method and apparatus for tailoring the electrostatic fields proximate to a transfer region to enable efficient transfer of charged toner particles in a high relative humidity environment.

Generally, the process of electrostatographic copying is executed by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. Charged developing material is subsequently deposited onto the photoreceptive member such that the toner particles are attracted to the charged image areas on the photoconductive surface thereof to develop the electrostatic latent image into a visible image. This developed image is then transferred from the photoreceptive member, either directly or after an intermediate transfer step, to a copy sheet or other support substrate, creating an image on the copy sheet corresponding to the original document. The transferred image may then be permanently affixed to the copy sheet through a process called "fusing". In a final step, the photoconductive surface of the photoreceptive member is cleaned to remove any residual developing material thereon in preparation for successive imaging cycles.

The electrostatographic copying process described above is well known and is commonly used for light lens copying of an original document. Analogous processes also exist in other electrostographic printing applications such as, for example, ionographic printing and reproduction, where charge is deposited on a charge retentive surface in response to electronically generated or stored images.

The process of transferring charged toner particles from an image support surface to a second supporting surface such as a copy sheet is realized at a transfer station. In a conventional transfer station, transfer is achieved by applying electrostatic force fields in a transfer region sufficient to overcome forces which hold the toner particles to the photoconductive surface on the photoreceptive member. These electrostatic force fields operate to attract and transfer the toner particles over onto the second supporting surface which may be either an intermediate transfer belt or an output copy sheet. An intermediate transfer belt is desirable for use in tandem color or one-pass paper duplex applications where successive toner powder images are transferred onto a single output copy sheet. These systems may also utilize multiple photoconductive drums or belts in lieu of a single photoconductive drum or belt.

Historically, transfer of developed toner images between support surfaces in electrostatographic applications is often accomplished via electrostatic induction using a corotron or other corona generating device. In corona induced transfer systems, the second supporting surface, such as an intermediate support member or an output copy sheet, is placed in direct contact with the developed toner image being supported on the image bearing surface (typically, a photoconductive surface) while the back of the second supporting surface is sprayed with a corona discharge. This corona discharge generates ions having a polarity opposite that of the toner particles, thereby electrostatically attracting and transferring the toner particles from the image bearing surface to the second supporting surface. An exemplary corotron ion emission transfer system is disclosed in U.S. Pat. No. 2,807,233.

Alternatively, transfer can be induced by applying a potential difference between the substrate of a biased member contacting the second supporting member and the substrate of the image bearing surface that originally supports the toner image. For example, a biased roll transfer system as first disclosed by Fitch in U.S. Pat. No. 2,807,233 has been used successfully to accomplish toner transfer. This patent disclosed the use of an electrically biased roll member coated with a resilient coating having a selected resistivity, providing a means for controlling the magnetic and non-magnetic forces acting on the toner particles during the transfer process. However, a shortcoming in such bias roll transfer systems results from the selected resistivity of the coating which sets a limit to the amount of electrical bias that can be applied to the roll. That is, at higher voltage ranges, the air in and about the transfer region begins to breakdown, or "ionize", causing the toner to splatter, whereby the image is caused to degrade during transfer. Nonetheless, bias transfer roll systems have become the transfer method of choice in state-of-the-art xerographic copying systems and apparatus. Notable examples of bias transfer roll systems are described in U.S. Pat. No. 3,702,482 by C. Dolcimascolo et al., and U.S. Pat. No. 3,781,105, issued to T. Meagher. Other general examples of biased roll transfer systems can be found in U.S. Pat. Nos. 2,807,233; 3,043,684; 3,267,840; 3,328,193; 3,598,580; 3,625,146; 3,630,591; 3,684,364; 3,691,993; 3,832,055; and 3,847,478.

As described, the process of transferring development materials in an electrostatographic system involves the physical detachment and transfer-over of charged toner particles from one surface into attachment with a second surface via electrostatic force fields. The critical aspect of the transfer process focuses on applying and maintaining high intensity electrostatic fields in the transfer region to overcome adhesive forces acting on the toner particles. Careful control of these electrostatic fields is required to induce the physical detachment and transfer-over of the charged toner particles without scattering or smearing of the developer material. This difficult requirement may be met by careful control or "tailoring" of the electrostatic fields across, as well as proximate to, the transfer region so that the fields are high enough to effect efficient toner transfer while being low enough so as not to cause arcing, excessive corona generation or excessive toner transfer in the regions prior to intimate contact between the second supporting surface and the toner image. Imprecise and inadvertent manipulation of these electrostatic fields can create copy or print defects by inhibiting toner transfer or by inducing uncontrolled toner transfer, causing scattering or smearing of the toner particles.

The specific problems associated with successful image transfer are well known. In the pre-transfer area, or the so called pre-nip region, immediately in advance of the transfer nip where the second supporting surface contacts the toner image, excessively high transfer fields can result in premature transfer across the air gap, leading to decreased resolution or blurred images. High transfer fields in the pre-nip air gap can also cause ionization which may lead to strobing or other image defects, loss of transfer efficiency, and a lower latitude of acceptable system operating parameters. Conversely, in the post-transfer area, or the so called post-nip region, at the photoconductor/second supporting surface separation area, insufficient transfer field (e.g. on the order of 12 volts/micron for line images, and 6 volts/micron for solid images) can cause image dropout and may generate hollow characters. Also, improper ionization in the post-nip region may cause image stability defects or create copy sheet detacking problems. Inducing variations in the desirable field strength across the transfer region must be balanced against the basic premise that the transfer field should be as large as possible (e.g. at least approximately 20 volts/micron) in the region directly adjacent the transfer nip where the second supporting surface contacts the toner image on the photoconductive surface so that high transfer efficiency and stable transfer can be achieved.

Variations in ambient environment conditions such as second supporting surface resistivity, the existence of contaminants in the transfer zone, and changes in the toner charge or in the adhesive properties of the toner materials,can all effect effective transfer parameters. Material resistivity and toner properties can change greatly with humidity and other environmental parameters. Specifically, it is well known that serious transfer problems, can be caused by copy paper conduction of the applied transfer potential, particularly in high humidity environments (reference U.S. Pat. No. 2,847,305, issued Apr. 12, 1958 to patentee L. E. Walkup).

Various approaches and solutions to the problems inherent to the transfer process have been proposed. The following disclosures may be relevant to various aspects of the present invention:

U.S. Pat. No. 3,850,519, Patentee: Weikel, Issued: Nov. 26, 1974

U.S. Pat. No. 4,014,605, Patentee: Fletcher, Issued: Mar. 29, 1977

U.S. Pat. No. 4,055,380, Patentee: Borostyan, Issued: Oct. 25, 1977

JP-A-55-29851, Patentee: Enoki, Issued: Mar. 3, 1980

DE-A-3104212, Patentee: Nishikawa, Issued: Dec. 10, 1981

U.S. Pat. No. 4,338,017, Patentee: Nishikawa, Issued: Jul. 6, 1982

JP-A-60-57860, Patentee: Haneda, Issued: Mar. 4, 1985

JP-A-61-170768, Patentee: Tagawa, Issued: Aug. 1, 1986.

U.S. Pat. No. 4,823,158, Patentee: Casey et al., Issued: Apr. 18, 1989

The relevant portions of the foregoing disclosures may be briefly summarized as follows:

U.S. Pat. No. 3,850,519 discloses a shield for preventing premature transfer of xerographic toner images from a photoconductive plate to a sheet of final support material. The shield is positioned so as to prevent charged ions from reaching the final support material prior to its placement in contact with the photoconductive plate, thereby preventing premature transfer of toner from the photoconductive plate to the sheet of final support material.

U.S. Pat. No. 4,014,605 discloses an electrostatographic copying system wherein toner transfer is accomplished by a transfer field generated by an electrically biased transfer member. The transfer field is tailored by providing a photoconductive layer in the transfer area. This photoconductive layer is illuminated to render it conductive in the nip and post-nip areas, but not in the pre-nip area, for providing the desired field tailoring effect.

U.S. Pat. No. 4,055,380 discloses a transfer charge maintaining system for use in an electrostatographic copier. Conductive members contacting the copy sheet in the transfer station are electrically connected to ground through a high resitance such that transfer leakage currents through the paper provide a compensatory self-biasing floating voltage on the conductive surface which oppose the leakage currents.

JP-A-55-29851 discloses an image transfer method employing a first corona discharge transfer device to apply a charge with the same polarity as the toner to a transfer paper. Subsequently, a second corona discharge transfer device, which is positioned behind the first discharge transfer device, applies a different (larger) opposite polarity charge to effect image transfer. The disclosed method of image transfer aims to improve transfer efficiency and to prevent any influence on the transfer process as a result of change of environmental conditions (i.e., change of relative humidity).

DE-A-3104212 discloses a toner transfer control apparatus for a photocopier including a photosensitive drum and a transfer roll and having a main bias control for applying a bias having the same polarity as the toner to the photosensitive drum while a transfer potential having an opposite polarity bias is applied to the transfer roll. The patent further discloses copy feed guides which are charged to control the charge on the paper passing therethrough to prevent smearing.

U.S. Pat. No. 4,338,017 discloses an electrophotographic apparatus comprising a photosensitive drum applied with a main transfer bias voltage which is adjustable and a transfer roll applied within auxiliary transfer bias voltage which is also adjustable.

JP-A-60-57860 discloses a toner image transfer method which prevents image deterioration in a pre-transfer area by giving a transfer sheet a charge of the same polarity as the toner before the transfer sheet reaches the transfer area. A first corona discharger in the pre-transfer area has a voltage of the same polarity as the toner applied to it to prevent early transfer and a second corona discharger in the transfer area has a voltage of the opposite polarity applied to it precipitate toner transfer.

JP-A-61-170768 discloses a transfer device which has a bias voltage and a bias current applied to a chute in a pre-transfer region. The bias voltage and bias current are supplied to the chute by a constant voltage supply and a constant voltage element. Bias current and voltage applied to the chute ensure that an appropriate electric field exists in a transfer area.

U.S. Pat. No. 4,823,158 discloses a biased pre-transfer baffle in an electrographic printing apparatus, the pre-transfer baffle being disposed adjacent to a transfer corotron and further being charged to a potential approximately the same as the photoreceptor.

In accordance with the present invention, an apparatus for transferring toner particles having a selected polarity charge from an image support surface to a copy substrate is disclosed, wherein transfer means positioned adjacent the image support surface, is provided such that the transfer apparatus defines a transfer zone, a pre-transfer zone, and a post-transfer zone. The transfer apparatus comprises means, positioned in the pre-transfer zone, for guiding the copy substrate into the transfer zone, the pre-transfer guide means being electrically biased to a voltage potential having a polarity substantially similar to the polarity of the charged toner particles so as to effectively minimize transfer fields in the pre-transfer zone, and further comprises means, positioned in the post-transfer zone, for guiding the copy substrate away from the transfer zone, the post-transfer guide means being electrically biased to a voltage potential having a polarity opposite the polarity of said charged toner particles so as to effectively enhance transfer fields in the post-transfer zone.

These and other aspects of the present invention will become apparent from the following description in conjunction with the accompanying drawings, in which.

Figure 5:
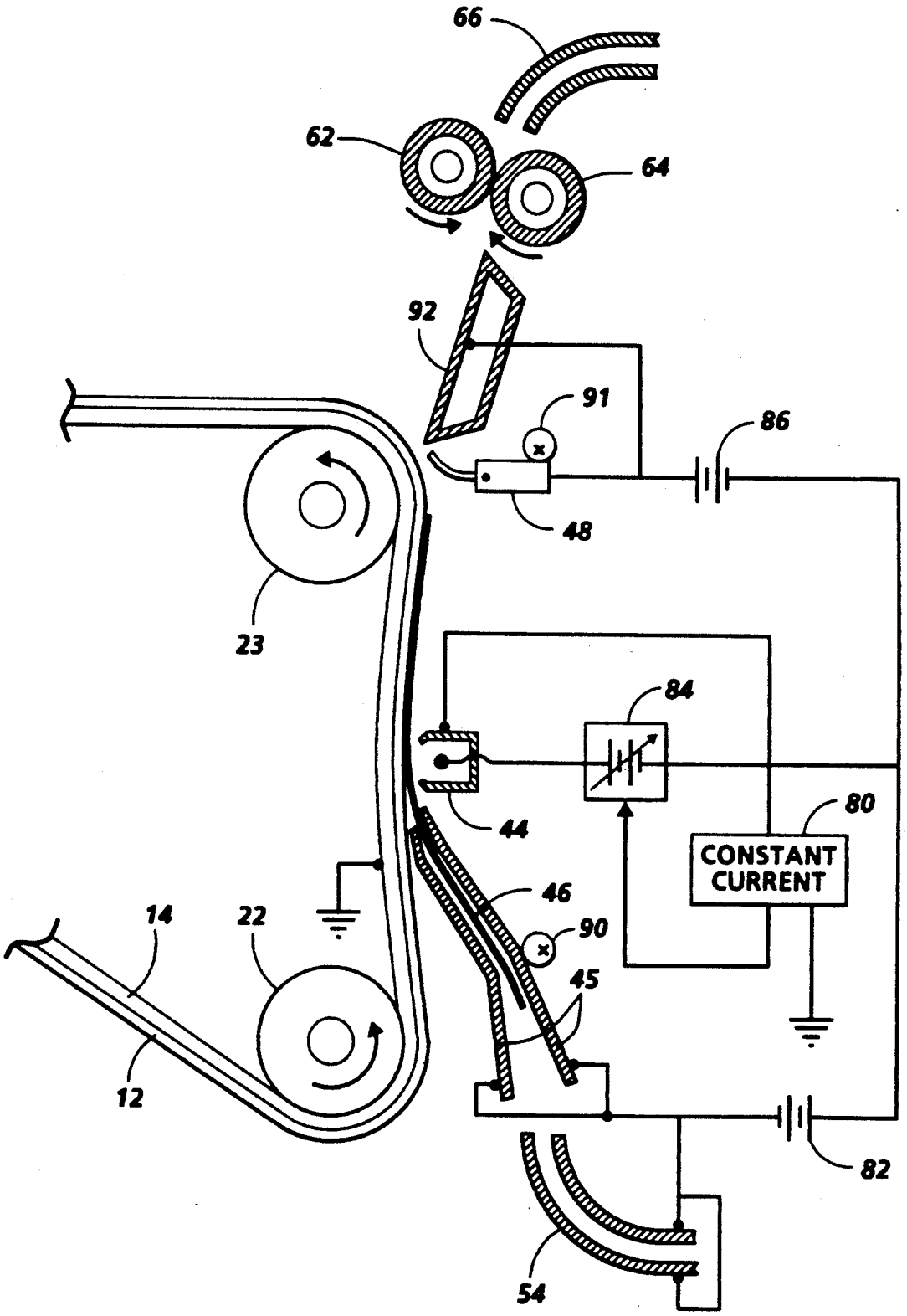
Figure 6:
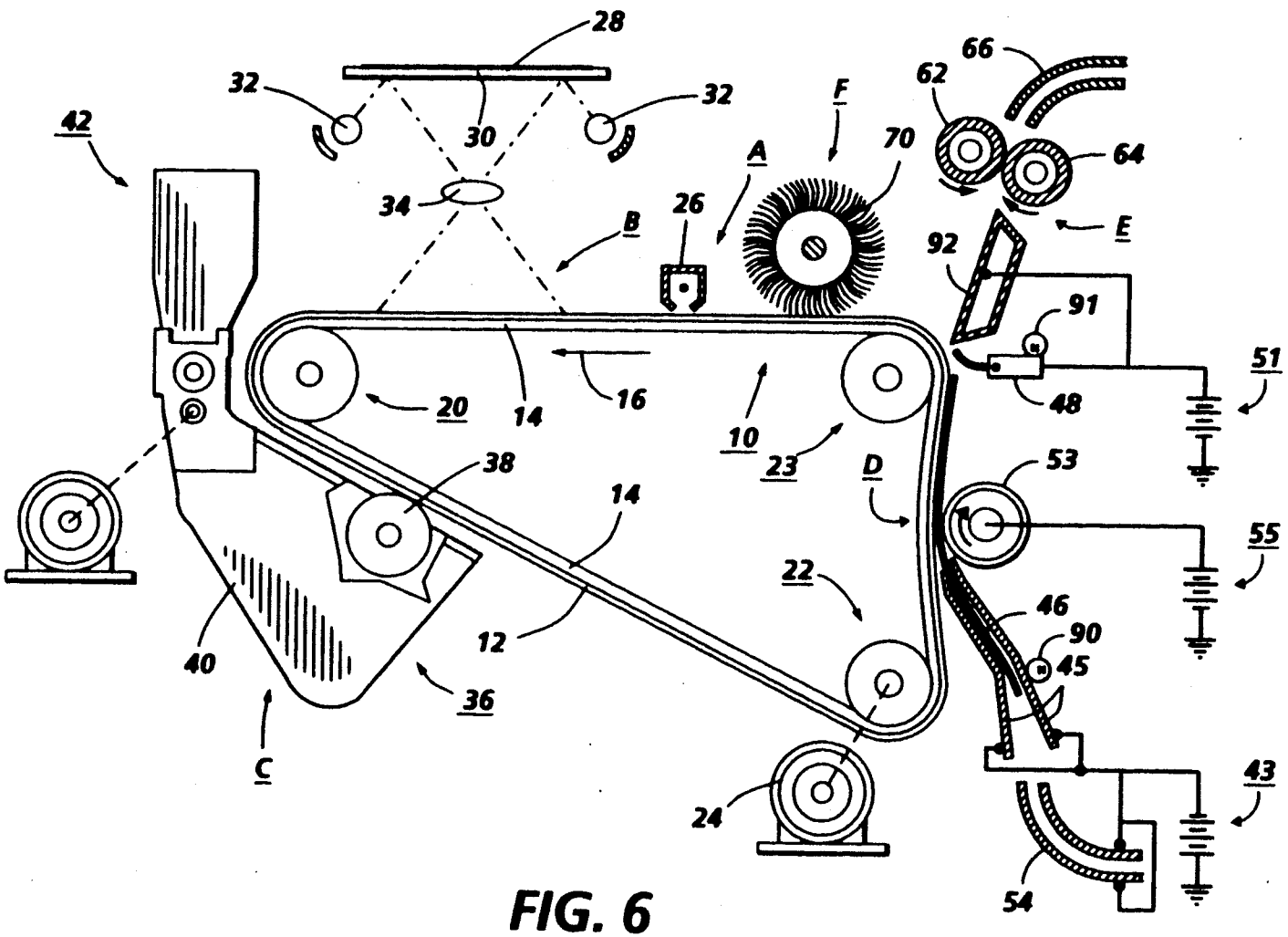

FIG. 5 is an enlarged schematic side view of yet another alternative embodiment of the transfer assembly of the present invention showing an alternative constant dynamic current configuration for providing the pre-transfer and post-transfer biasing; and FIG. 6 is a schematic elevational view illustrating an exemplary electrostatographic printing machine incorporating the features of the present invention.

While the present invention will be described with reference to a preferred embodiment thereof, it will be understood that the invention is not to be limited to this preferred embodiment. On the contrary, it is intended that the present invention cover all alternatives, modifications, and equivalents as may be included within the spirit and scope of the invention as defined by the appended claims. Other aspects and features of the present invention will become apparent as the following description progresses, with specific reference to the drawings, wherein like reference numerals have been used throughout the drawings to designate identical elements therein.

For a general understanding of an exemplary electrostatographic printing machine incorporating the features of the present invention, reference is initially made to FIG. 6, wherein a schematic depiction of the various machine components is provided. Although the apparatus of the present invention is particularly well adapted for use in an automatic electrophotographic reproducing machine as shown in FIG. 5, it will become apparent from the following discussion that the present transfer assembly is equally well suited for use in a wide variety of electrostatographic processing machines as well as many other known printing systems. It will be further understood that the present invention is not necessarily limited in its application to the particular embodiment or embodiments shown herein.

Moving now to a description of FIG. 6 before discussing the features of the present invention in detail, the exemplary electrophotographic reproducing apparatus employs a belt 10 including a photoconductive surface 12 deposited on an electrically grounded conductive substrate 14. Drive roller 22, coupled to motor 24 by any suitable means, as for example a drive belt, is engaged with belt 10 to transport the belt 10 about a curvilinear path defined by drive roller 22, and rotatably mounted tension rollers 20, 23. This system of rollers 20, 22, 23 is used for advancing successive portions of photoconductive surface 12 in the direction of arrow 16, through various processing stations disposed about the path of movement thereof, as will be described.

Initially, a segment of belt 10 passes through charging station A. At charging station A, a corona generating device or other charging apparatus, indicated generally by reference numeral 26, charges photoconductive surface 12 to a relatively high, substantially uniform potential.

Once charged, the photoconductive surface 12 is advanced to imaging station B where an original document 28, positioned face down upon a transparent platen 30, is exposed to a light source, i.e., lamps 32. Light rays from the light source 32 are reflected from the original document 28 for transmission through a lens 34 to form a light image of the original document 28 which is focused onto the charged portion of photoconductive surface 12. The imaging process has the effect of selectively dissipating the charge on the photoconductive surface 12 in areas corresponding to non-image areas on the original document to record an electrostatic latent image of the original document 28 onto photoconductive surface 12. Although an optical imaging system has been shown and described herein for forming the light image of the information used to selectively discharge the charged photoconductive surface 12, one skilled in the art will appreciate that a properly modulated scanning beam of energy (e.g., a laser beam) may be used to irradiate the charged portion of the photoconductive surface 12 for recording a latent image thereon.

After the electrostatic latent image is recorded on photoconductive surface 12, belt 10 advances to development station C where a magnetic brush development system, indicated generally by reference numeral 36, deposits particulate toner material onto the electrostatic latent image. Preferably, magnetic brush development system 36 includes a single developer roll 38 disposed in developer housing 40. In the developer housing 40, toner particles are mixed with carrier beads, generating an electrostatic charge therebetween which causes the toner particles to cling to the carrier beads to form developing material. The magnetic developer roll 38 is rotated in the developer housing 40 to attract the developing material therein to form a "brush" having carrier beads and toner particles magnetically attached thereto. As the developer roller 38 continues to rotate into contact with belt 10, developing material is brought into contact with the photoconductive surface 12 such that the latent image thereon attracts the toner particles from the developing material to develop the latent image into a visible image. A toner particle dispenser, indicated generally by reference numeral 42, furnishes a supply of additional toner particles to housing 40 in order to sustain the developing process.

After the toner particles have been deposited onto the electrostatic latent image for creating a toner image thereof, belt 10 advances the developed image to transfer station D. At transfer station D, a sheet of support material 46 is moved into contact with the developed toner image through chute 54 for synchronous contact with the developed toner image. Chute 54 directs the advancing sheet of support material 46 into pre-nip baffle 45 for guiding the support material 46 into contact with photoconductive surface 12 of belt 10. The developed image on photoconductive surface 12 thereby contacts the advancing sheet of support material 46 in a timed sequence and is transferred thereon at transfer station D. In the illustrated embodiment, a bias transfer roll 53 is provided for establishing a directional electrostatic field capable of attracting toner particles from the photoconductive surface 12 to support material 46. The bias roller also provides a pressure contact force against copy substrate 46 to insure intimate contact between the copy sheet 46 and the toner image surface of belt 10 to substantially eliminate large air gaps therebetween. Many alternative means for achieving such intimate contact are also possible. For example, a configuration including a corotron device and biased pressure assist blades can be used, as will be described. The details of the transfer process and the specific features of the transfer apparatus of the present invention will be discussed in greater detail herein with reference to FIGS. 1–5.

The support material 46 is subsequently separated from the belt 10 and transported to a fusing station E. Fusing station E includes a fuser assembly, preferably comprising a heated fuser roll 62 and a support roll 64 spaced relative to one another for receiving a sheet of support substrate 46 therebetween. The toner image is thereby forced into contact with the support material 46 between fuser rollers 62 and 64 to permanently affix the toner image to support material 46. After fusing, chute 66 directs the advancing sheet of support material 46 to receiving tray (not shown) for subsequent removal of the finished copy by an operator.

Invariably, after the support material 46 is separated from belt 10, some residual developing material remains adhered to the photoconductive surface 12 thereof. Thus, a final processing station, namely cleaning station F, is provided, for removing residual toner particles from photoconductive surface 12, subsequent to transfer of the toner image to the support material 46 from belt 10. Cleaning station F can include a rotatably mounted fibrous brush 70 for physical engagement with photoconductive surface 12 to remove toner particles therefrom by rotation thereacross. Removed toner particles are stored in a cleaning housing chamber (not shown). Cleaning station F can also include a discharge lamp (not shown) for flooding photoconductive surface 12 with light in order to dissipate any residual electrostatic charge remaining thereon in preparation for a subsequent imaging cycle.

The foregoing description should be sufficient for the purposes of the present application for patent to illustrate the general operation of an electrophotographic reproducing apparatus incorporating the features of the present invention. As described, the electrophotographic reproducing apparatus may take the form of any of several well known devices or systems. Variations of specific electrostatographic processing subsystems or processes may be expected without affecting the operation of the present invention.

Referring now to the details of the present invention, and in particular to FIGS. 1–4 where alternative embodiments of a transfer assembly in accordance with the present invention are illustrated, it will be noted that an important advantage of the present invention comes from the feature that allows transfer fields to be tailored in and around the transfer nip. Tailored transfer fields are provided via a dynamic transfer system wherein conductive members proximate to the transfer nip are selectively biased to vary the effective applied potential thereat.

Figure 1:
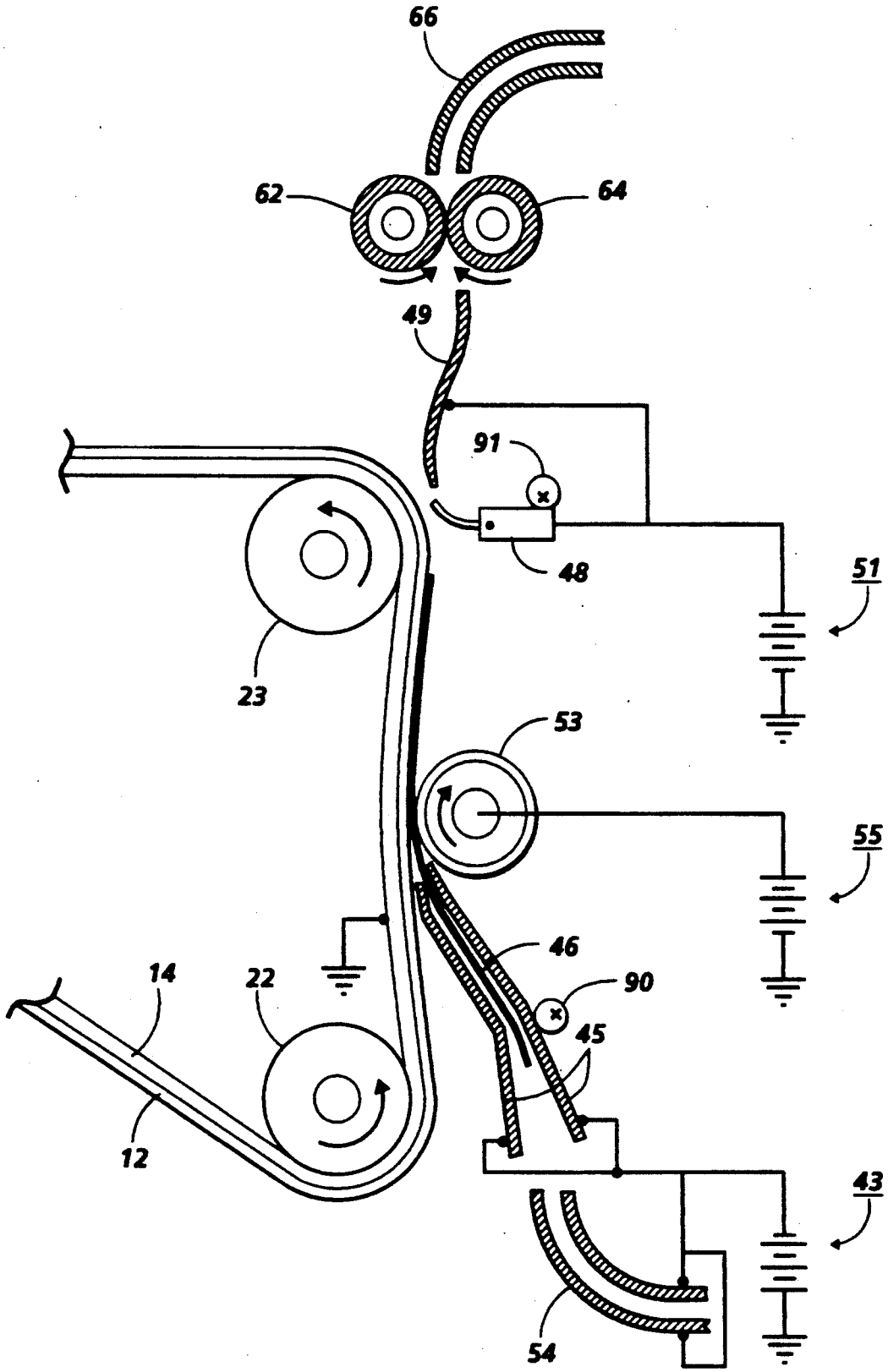
FIG. 1 is an enlarged schematic side view of an embodiment of the transfer assembly of the present invention showing the biased pre-transfer and post-transfer contact members of the present invention.

A transfer charging assembly including a bias transfer roll 53 is shown in FIG. 1 in a configuration adapted to form a transfer nip between the roll 53 and the photoconductive surface 12 of belt 10. It is noted that a corona generating device, shown in FIG. 3 as reference numeral 44, may be utilized to provide the transfer charging assembly of the present invention wherein a transfer zone is created between the corona generating device 44 and the belt 10. The following description will describe the present invention in terms of a bias transfer roll configuration. However, it will be understood that the present invention may be implemented via a corona charging apparatus as well as other known transfer charging devices. The transfer nip is adapted to receive the copy substrate 46, which allows the copy substrate 46, such as copy paper or the like, to cooperate with a toner image on the photoconductive surface 12 of belt 10 when brought into contact therewith. The bias transfer roll 53 attracts charged toner particles thereto from the photoconductive surface 12, so as to transfer the developed toner image on the photoconductive surface 12 from the belt 10 to the copy substrate 46, positioned therebetween.

In the embodiment of FIG. 1, the bias transfer roll 53 is electrically coupled to a biasing source 55 and the electrically conductive substrate 14 of belt 10 is connected to ground, creating an electrical potential difference therebetween. This potential difference can be further enhanced by applying a transfer bias to the conductive substrate 14 of belt 10, the polarity of which is the same as the charging polarity of the toner particles thereon. It is noted that the polarity of charges shown, as well as those intimated in the presently described system, are provided for illustration purposes only such that the present invention may be practiced in systems using different polarity schemes In the transfer nip, the copy substrate 46 is subjected to transfer charges from the bias transfer roll 53 to effect transfer of toner particles to the copy substrate 46 by depositing transfer charges on the area of the copy substrate 46 in contact with the bias transfer roll 53. Thus, the electrical bias applied to bias transfer roll 53 which provides a potential difference between the belt 10 and the roll 53 has the effect of attracting charged toner particles from the photoconductive surface 12 to the copy substrate 46 therebetween, thereby transferring the developed toner image from the belt 10 to the copy substrate 46.

Figure 3:
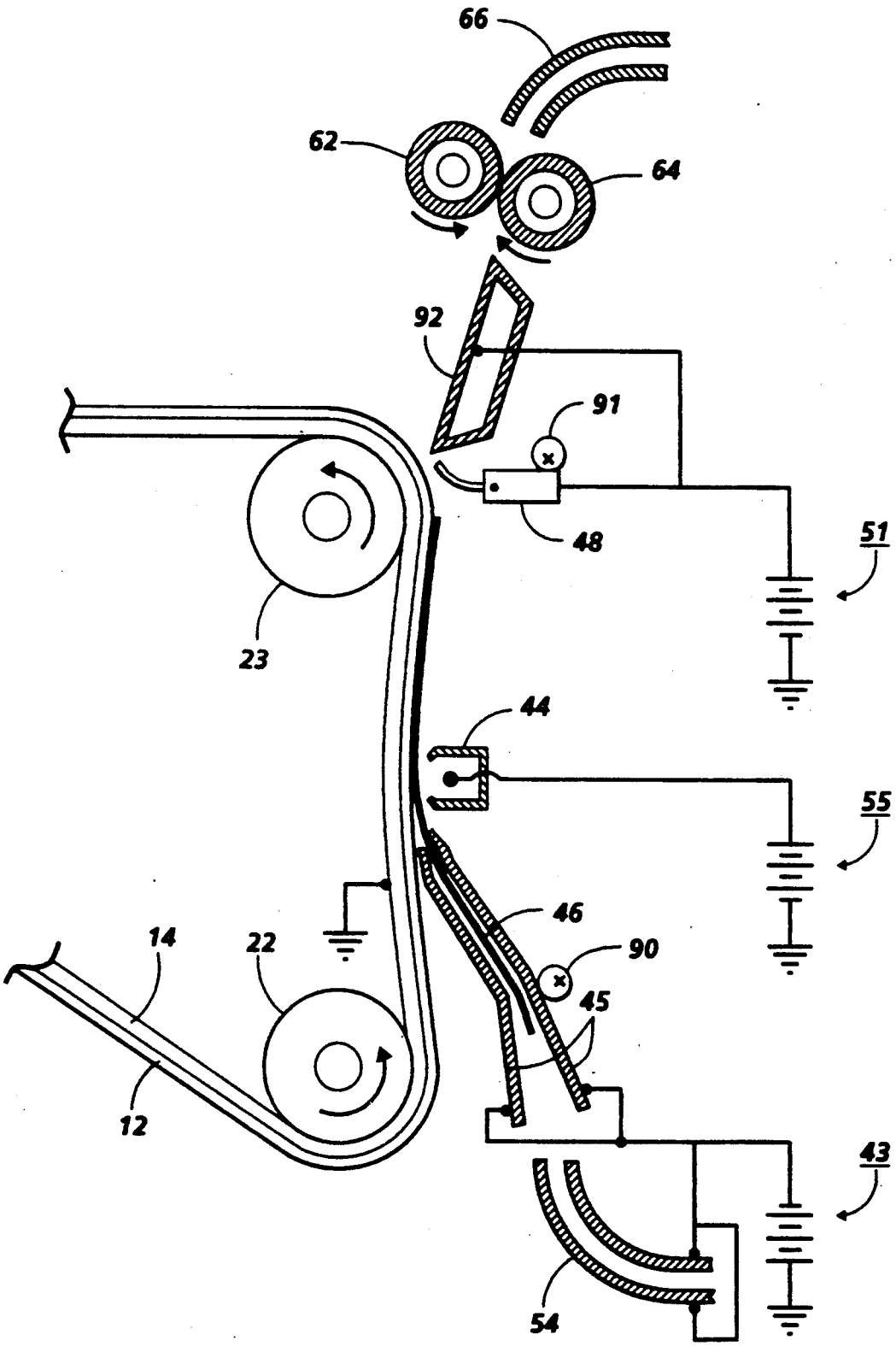
FIG. 3 is an enlarged embodiment showing another alternative embodiment of the present invention.

As shown in FIG. 1, the copy substrate 46 is carried into the transfer nip for alignment and registration with the toner image on the belt 10 through conductive sheet guide members 45, located adjacent to the transfer nip. In the transfer nip, the copy substrate 46 is subjected to transfer charges from transfer charging device which may include a bias transfer roll 53, as shown in FIG. 1, or a corona generating device 44, as shown in FIG. 3. The transfer charges generated thereby effect transfer of toner particles to the copy substrate 46 by depositing transfer charges on the area of the copy substrate 46 contacting the photoconductive layer 12 of belt 10. The copy substrate 46 is then transported out of the transfer nip, is initially stripped from the imaging surface 12 and is subsequently transported to the fusing station including rollers 62 and 64.

Figure 2:
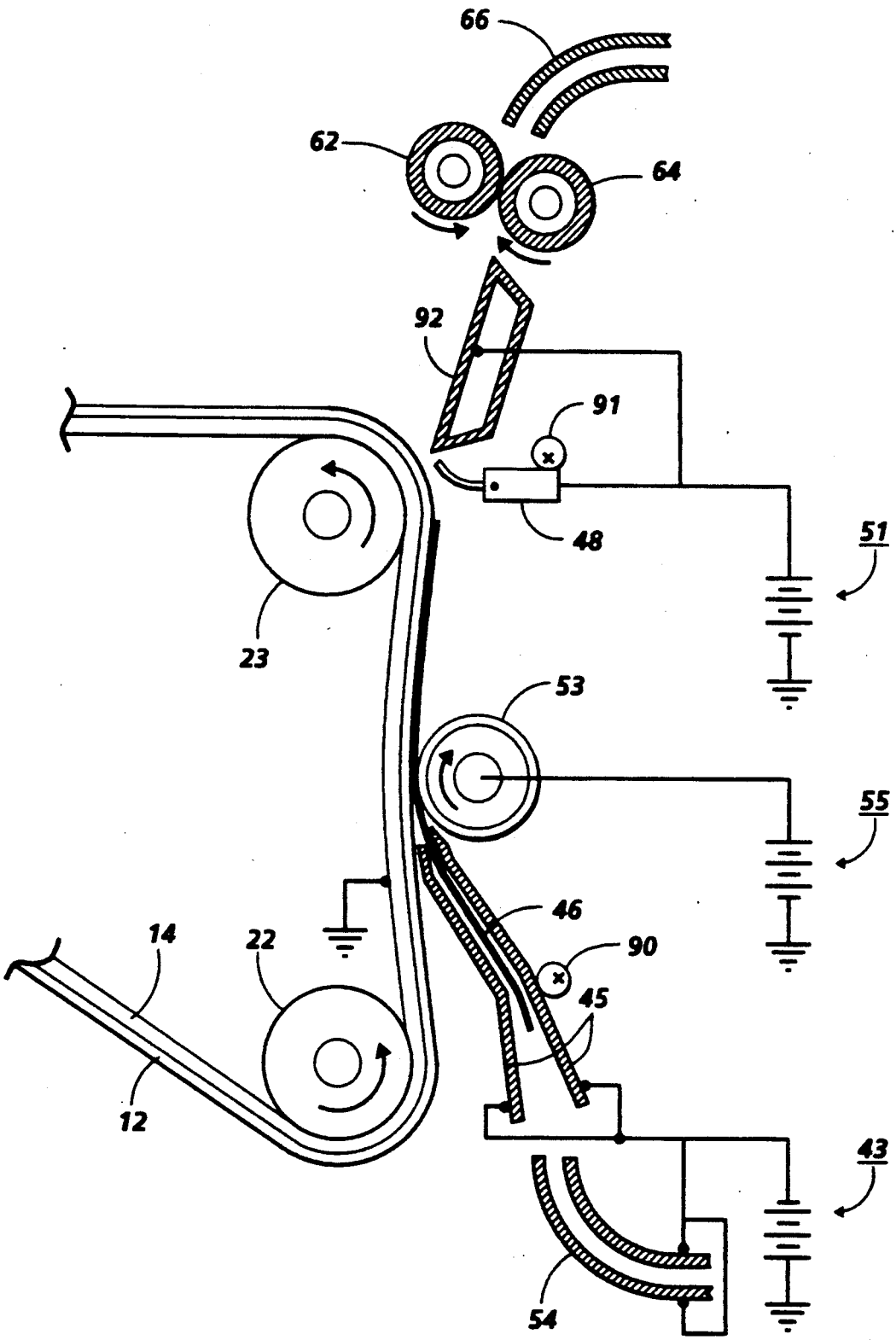
FIG. 2 is an enlarged schematic showing an alternative preferred embodiment of the transfer assembly of the present invention.

The stripping mechanism shown in FIG. 1 is a preferred "self stripping" apparatus known in the art, wherein roller 23 is chosen to have a sufficiently small diameter to enable the copy sheet 46 to be stripped from the surface 12 due to the inherent beam strength of the copy sheet 46. Typically, the diameter of roller 23 is approximately 25 mm or less to permit self stripping, but can be varied with respect to the copy sheet stiffness to allow for self-stripping. Alternatively, a stripping assist device such as a detack corona generating device, a vacuum generating means (as shown in FIG. 2) or a stripper finger, as are all well known in the art, can be utilized to assist in directing the copy substrate 46 away from the surface 12 and towards fuser station E.

The transfer apparatus of the present invention also includes biased conductive member 48, cooperative with the self-stripping feature described above, for contacting copy substrate 46 at some point subsequent to the transfer nip. In operation, the copy substrate 46 is slidably supported in contact with the biased conductive contact members 48 and transported away from the transfer nip into the nip of the image fusing station made up of rollers 62 and 64. Transport of the copy substrate to the fusing station can be assisted by a conventional vacuum belt transport 92, as shown in FIG. 2, or by a simple baffle guide assembly 49 (as shown in FIG. 1), as are well known and practiced in the art. It will be appreciated that the components described herein are merely exemplary of various conventional input and output sheet handling, guiding, feeding stripping or deflecting members for a xerographic transfer station. Any other such conductive members which may contact copy sheet 46 while any part of the sheet is in the transfer nip would preferably be insulated and connected to biasing sources in the same manner as will be described and as shown.

Conductive member 48 is preferably positioned adjacent belt 10 for allowing contact with sheet 46 as it is transported along the belt 10. Conductive member 48 is preferably fabricated from a sufficiently conductive material having a resistivity less than approximately $10^9$ ohm-cm. The conductive member 48 can take the form of a fiber brush or a conductive shim. Preferably, the conductive member 48 will create minimal friction forces on the copy substrate 46 as it is transported through the transfer region.

The conductive member 48 may also be coupled to a camming wheel 91 or other device for allowing selective mechanical engagement of the conductive member 48 against the copy sheet 46. The camming mechanism 91 is activated just after the lead edge of the copy substrate 46 passes adjacent to the conductive member to create force against the copy substrate 46, thereby insuring the desired intimate contact between the copy substrate 46 and belt 10 so that large air gaps do not exist adjacent to the transfer nip. Large air gaps may lead to transfer copy quality defects which are particularly troublesome in high relative humidity environments, as is well known in the art.

It is noted here that a similar camming wheel 90 or other device can be coupled into engagement with conductive sheet guide member 46 to provide mechanical engagement of the conductive guide member 45 with the copy sheet 46 in the pre-transfer region to enhance pre-nip contact between the copy sheet 46 and the belt 10. It will be appreciated that such selective mechanical engagement of sheet guide member 45 and/or conductive member 48 should be accomplished only while the copy substrate 46 is present so as to minimize possible damage due to contact with the photoconductive surface 12 of belt 10. In addition, members 45 and/or 48 can be selectively segmented to correspond to the widths of the copy substrate in use during a given copy run, to further reduce the opportunity for inadvertent contact with the photoconductive surface 12.

The pre-transfer nip baffle 45 and the post-transfer nip conductive member 48 are each coupled to a biasing source 43 and 51, respectively. Biasing sources 43 and 51 provide an electrical potential to the respective conductive copy sheet guide members. The polarity and the magnitude of the bias potential applied to pre-nip baffle 45 is selected to substantially offset the surface potential of the photoconductor in the pre-nip area so as to create an equivalent voltage across the air gap that is sufficiently low near and above a critical air gap region, as will be further described below. Conversely, the polarity and magnitude of the bias potential applied to the post-nip conductive member 48 is selected to substantially maximize the equivalent potential in the transfer nip and the post-transfer nip region, as will also be discussed. The desired potentials applied to the conductive pre and post-transfer members will be dependent on the surface potential above the image bearing surface, among other factors. It will be appreciated that the appropriate selected potential to be applied to the components of the present invention is also dependent on the specific parameters of the transfer apparatus, including the geometry of the transfer system. Analytically, system parameters can be estimated, and the critical functional dependence of the various parameters can be determined to arrive at the preferred applied potentials. An equation for determining such preferred applied potentials will now be described.

As previously noted, the problem addressed by the transport apparatus of the present invention focuses on the fact that it has been found that, under certain conditions and for certain copy sheet materials, the charges placed on the copy sheet by the transfer charging device are conducted, to a significant degree, through the copy substrate 46. For example, in a high relative humidity environment, a copy sheet exhibits relatively low resistivity. The copy sheet, therefore, acts somewhat like a resistive element which laterally conducts the output current on the transfer charging device through the copy sheet. This lateral conduction has two effects: lateral conduction of the charge applied by the transfer charging device, be it a bias transfer roll, a transfer corona device or any other suitable device, can lower the effective applied charge on the copy sheet in the transfer nip by causing a portion of the applied charge concentration in the transfer nip to flow laterally away therefrom along the copy sheet; also, lateral conduction of the charge from the transfer charging device can generate sufficient charge in the pre-nip and post-nip areas to effect transfer of toner thereat. Lowering the effective applied charge can also reduce the pre-nip electrostatic fields that cause unwanted toner transfer across the pre-nip air gaps. However, elimination of these pre-nip transfer fields can result in a loss of transfer efficiency and/or hollow characters by reducing the maximum transfer field which can be generated.

The present invention solves the problem of lateral conduction of transfer charge through the copy substrate 46 by applying selective potentials to the conductive elements near the transfer nip to allow low electrostatic fields in the pre-nip regions while still allowing the desired high electrostatic fields in the transfer nip and the post-transfer region during separation of the copy sheet 46 from the image bearing surface of belt 10.

The appropriate value of the bias voltage applied to the baffle 45 and the conductive member 48 is, in general, dependent on the toner properties and the transfer zone geometry of the system and can be determined experimentally for any system. It has been found that the following equation provides a useful model of the equivalent electrostatic fields in the transfer region:

$$E = \frac{[(X_1V_a + X_2V_b)/(X_1 + X_2)] - V_{pc}}{D_{air} + \Sigma_n(dlk)_n}$$

This equation determines the applied electrostatic field (E) at a given critical position ($X_1$) relative to the transfer nip. The parameters $X_1+X_2$ represent the distance between the conductive member adjacent the transfer nip (either baffle 45 or conductive member 48) and the transfer nip. $V_a$ is the value of the potential applied to the transfer member by biasing source 55, respectively; $V_b$ is the value of the potential applied to the conductive guide member 45 or 48 by biasing source 43 or 51, respectively; and $V_{pc}$ is the value of the surface potential immediately adjacent the surface of photoconductive layer 12 in a toner image region outside the transfer nip. The value $V_{pc}$ is the value that a non-contacting voltmeter would measure in regions sufficiently distant from the transfer zone to avoid the influences of the transfer system as created by surface charge density, toner charge and applied substrate potentials. Thus, the numerator of the equation is a voltage term providing the equivalent applied voltage at a predetermined point as the result of applied bias voltages in the system.

The terms in the denominator of the preceding equation represent a geometric constant determined by the dimension of the air gap ($D_{air}$) between the copy substrate and the toner image on the photoconductor and the sum of all thicknesses (d) of the materials of the photoreceptor and the toner material divided by the dielectric constants (k) of these materials.

It can be seen from this equation that, by choosing the applied bias voltages to be an appropriate magnitude having the same polarity as the voltage $V_{pc}$ of the photoconductor, the equivalent potential, and thus the electrostatic fields at a predetermined point in the pre-nip region can be driven toward zero thereby minimizing the transfer fields in the pre-nip air gap to inhibit toner transfer therein. In practice, the optimum applied pre-nip potential will typically be comparable in magnitude to the value of $V_{pc}$. Conversely here, it is important to generate high transfer fields in the transfer nip and in the post-nip zone during initial separation of the copy substrate from the photoconductive surface 12 of belt 10. In this case, the voltage provided by bias source 51 is selected to maximize the equivalent potential in the transfer nip region and at the copy substrate 46 separation point from the surface 12. It will be appreciated that the appropriate equivalent potential required depends on the details of the transfer configuration, and the geometry of the transfer system. An equation similar to the previous equation can be written to estimate the applied electrostatic fields in the transfer nip and in the post nip zone.

In the pre-transfer zone, it is particularly interesting to concentrate on the particular position at which the air gap between the copy substrate 46 and the toner image on the photoconductor 12 is approximately 50 microns. In practice, it has generally been found that severe toner splatter problems due to transfer of toner across air gaps can be prevented by keeping the transfer field below a threshold value necessary to initiate significant toner transfer at air gaps greater than about 50 microns. Typically, suppression of fields to a level below about 2 volts/micron at air gaps greater than about 50 microns will be sufficient for most toner transfer systems. It will be appreciated by those of skill in the art that higher fields can be allowed in systems using toners that do not transfer well at low fields, and that the specific air gap and field requirements depend on the toner used as well as the degree of copy quality degradation that is tolerable for a given electrostatic system.

Similarly, a transfer field greater than approximately 20 volts/micron is required to be present during initial separation of the copy substrate for high transfer efficiency, and a transfer field at least this high and preferably higher than this, in the 40 volt/micron range, is typically desired in the transfer nip when the copy substrate is in contact with the photoreceptor. It can be appreciated that specific levels needed will depend on, for example toner adhesion, toner charge, etc.

It will be further noted, with respect to the pre-nip fields, a field profile that stays below the Paschen breakdown curve in the pre-nip air gap is another constraint for the applied potentials previously discussed. This condition can be experimentally or analytically determined, but pre-nip air breakdown will typically be avoided if the condition of $<2$ volts/micron at air gaps above 50 microns is achieved for gap transfer avoidance.

The equation provided herein is generally applicable when the lateral relaxation time for charge flow along the copy substrate 46, from the transfer nip region to the region $X_2$, is much smaller than the dwell time for the paper to travel between the region near $X_2$ to the transfer nip region. In this condition, the copy substrate material can be treated substantially as a resistive element and the voltage drop along the material will accordingly be determined by simple resistive division. System conditions and resistivity conditions for treatment of the copy substrate as a simple resistive element can be readily experimentally measured or analytically determined for any transfer zone geometry.

It will be appreciated that the invention taught here is not restricted to the case where the copy substrate begins to behave like a resistive element. However, in practice, it is this condition that provides the solution to lateral conduction problems addressed by the present invention. The teaching of the present invention will be useful in solving any lateral conduction condition that exists in the system. With most paper transfer substrates and most typical transfer geometries, the equation will invaribly be valid at least with papers conditioned to 85% relative humidity. In many cases, such as with high salt content papers, low process speed machines, or small transfer nip geometry systems, the equation taught herein can be valid for much lower relative humidity conditions. It will be appreciated that different types of substrates than paper will have their individual particular characteristics and response to environmental parameters. Detailed analytical discussion of lateral conduction can be found in IS & T Final Program and Proceedings, Advances in Non-Impact Printing Technologies, G. Fletcher, "Lateral Conduction Effects in Electrostatic Systems", Oct. 6–11, 1991 Proceedings.

Figure 4:
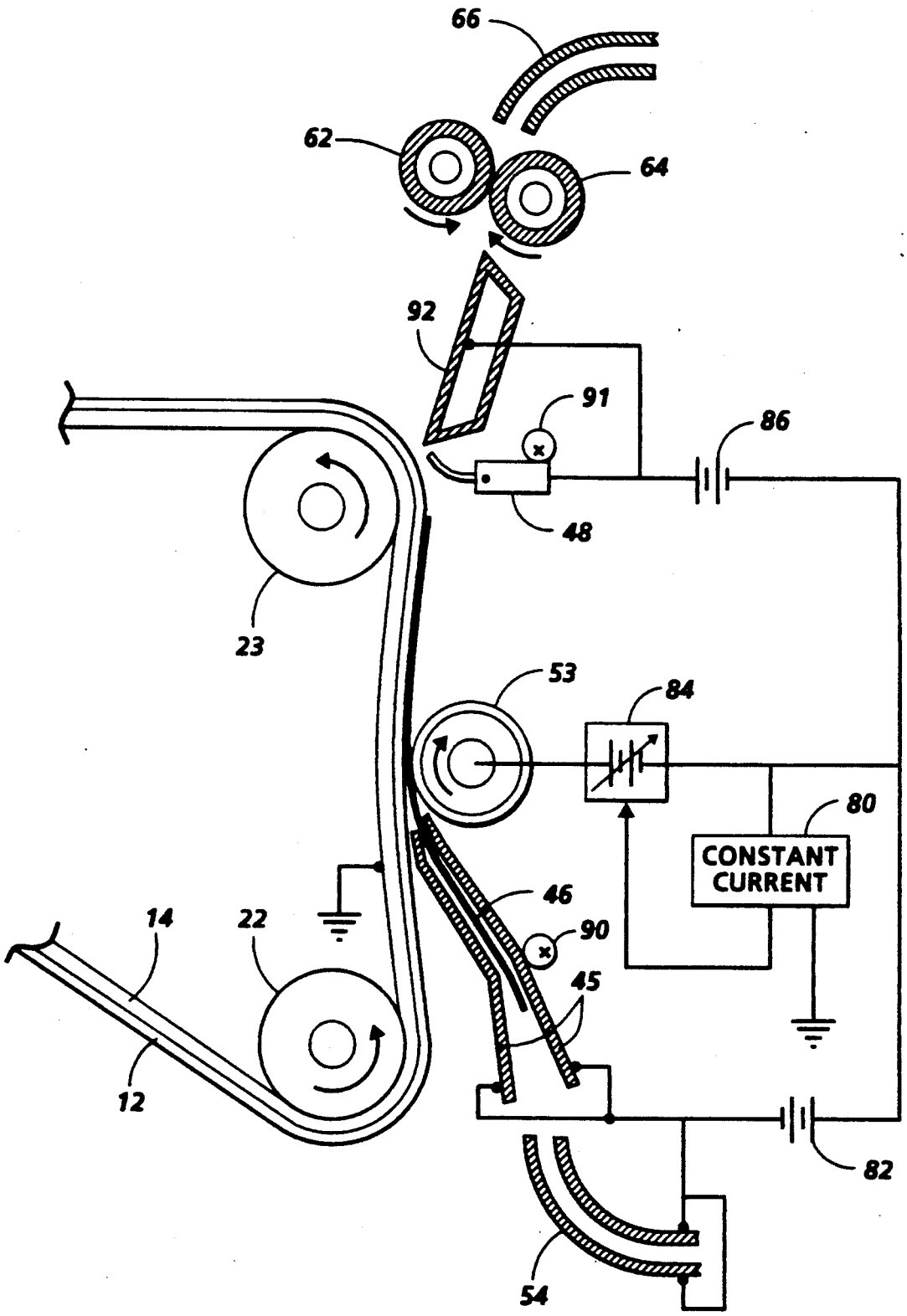
FIG. 4 is an enlarged schematic side view of an alternative embodiment of the transfer assembly of the present invention showing the use of a constant dynamic current configuration for providing the pre-transfer and post-transfer biasing.

While FIGS. 1–3 show alternative embodiments of the present invention wherein appropriate bias voltages are applied to the conductive members 45 and 48 via independent biasing sources 43 and 51. FIGS. 4 and 5 show additional embodiments for carrying out the teachings of the present invention through the use of a constant dynamic current configuration. In this embodiment, a bias transfer roll 53 is shown in the transfer nip where each biasing source 82, 84 and 86 is coupled to a constant current source 80 and the current therefrom is returned to the bias transfer roll biasing source 84 so as to provide constant dynamic current thereto. Alternatively, a corona generating device could be similarly utilized, as shown in FIG. 5, where the current flow from the corona device shield is returned to the current regulation source 84 so that the shield current is not measured by the constant current regulator circuit 80. Thus, in these alternative embodiments, means are provided for returning the currents from the pre and post-transfer conductive components in order to clamp the net current through the transfer apparatus to a constant level.

In recapitulation, the electrophotographic printing apparatus of the present invention includes a toner transfer system having a transfer charging device providing an applied transfer potential to a transfer nip having a first polarity and magnitude, a biased pre-nip baffle providing a charge of a second polarity and magnitude such that the equivalent applied potential in the pre-transfer region is driven to provide low applied electrostatic fields, and a biased post-nip conductive guide member providing a charge having the same polarity as the first polarity and a magnitude that causes high fields in the transfer nip and the post-transfer region during separation of the copy substrate. A biasing source is provided so that the pre-nip baffle is biased to shield an equivalent voltage across the air gap which is driven to a sufficiently low value at critical air gap regions to eliminate the occurrence of premature toner transfer. Conversely, a post-nip biasing source is coupled to the post-nip conductive member for providing voltage potential having a polarity and magnitude to drive the post-nip equivalent potential to a relatively high level in the transfer nip and in the post-transfer region during copy substrate separation, thereby maintaining high transfer fields from the transfer nip to the post-nip region.

It is, therefore, evident that there has been provided, in accordance with the present invention, an electrophotographic printing apparatus that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, the present application for patent is intended to embrace all such alternatives, modifications, and variations as are within the broad scope and spirit of the appended claims.

I claim:

1. An apparatus for transferring toner particles having a selected polarity charge from an image support surface to a copy substrate, comprising transfer means positioned adjacent said image support surface to define a transfer zone for transferring the toner particles to the copy substrate and further defining a pre-transfer zone and a post-transfer zone;

means, positioned in the pre-transfer zone, for guiding said copy substrate into the transfer zone, said pre-transfer guide means being electrically biased to a voltage potential having substantially the same polarity as that of the charged toner particles so as to effectively minimize transfer fields in the pre-transfer zone to substantially prevent toner transfer therein; and means, positioned in the post-transfer zone, for guiding said copy substrate away from the transfer zone, said post-transfer guide means being electrically biased to a voltage potential having the opposite polarity as that of the charged toner particles so as to effectively enhance transfer fields in the post-transfer zone to substantially enhance toner transfer in the transfer zone adjacent thereto.

2. The apparatus of claim 1, wherein said pre-transfer guide means comprises:

an electrically conductive pre-transfer guide member; and an electrical biasing source coupled to said pre-transfer guide member.

3. The apparatus of claim 2, wherein said post-transfer guide means comprises:

an electrically conductive post-transfer guide member; and an electrical biasing source coupled to said post-transfer guide member.

4. The apparatus of claim 3, further comprising a variable electrical biasing means, coupled to said transfer means, for electrically biasing said transfer means to a polarity opposite the polarity of said charged toner particles.

5. The apparatus of claim 4, further including a constant current source, coupled to said variable electrical biasing means, for providing a constant current signal thereto.

6. The apparatus of claim 3, wherein said transfer means includes a bias transfer roll.

7. The apparatus of claim 3, wherein said transfer means includes a corona generating device.

8. The apparatus of claim 3, wherein said post-transfer guide means includes an electrically conductive flexible brush.

9. The apparatus of claim 3, wherein said post-transfer guide means includes a vacuum transport device.

10. The apparatus of claim 3, wherein said pre-transfer guide means includes an electrically conductive baffle.

11. The apparatus of claim 3, wherein said pre-transfer guide means includes means, coupled to said electrically conductive pre-transfer guide member, for providing selective mechanical engagement of said pre-transfer guide member against the copy substrate to induce intimate physical contact between the copy substrate and the image support surface in the pre-transfer zone.

12. The apparatus of claim 3, wherein said post-transfer guide means includes means, coupled to said electrically conductive post-transfer guide member, for providing selective mechanical engagement of said post-transfer guide member against the copy substrate to induce intimate physical contact between the copy substrate and the image support surface in the post-transfer zone.

13. An electrostatographic printing machine of the type in which a developed toner image having a selected polarity charge is transferred from an image support surface to a copy substrate including a transfer apparatus, comprising:

transfer means positioned adjacent said image support surface to define a transfer zone for transferring the toner particles to the copy substrate and further defining a pre-transfer zone and a post-transfer zone;

means, positioned in the pre-transfer zone, for guiding said copy substrate into the transfer zone, said pre-transfer guide means being electrically biased to a voltage potential having substantially the same polarity as that of the charged toner particles so as to effectively minimize transfer fields in the pre-transfer zone to substantially prevent toner transfer therein; and means, positioned in the post-transfer zone, for guiding said copy substrate away from the transfer zone, said post-transfer guide means being electrically biased to a voltage potential having the opposite polarity as that of the charged toner particles so as to effectively enhance transfer fields in the post-transfer zone to substantially enhance toner transfer in the transfer zone adjacent thereto.

14. The apparatus of claim 13, wherein said pre-transfer guide means comprises:

an electrically conductive pre-transfer guide member; and an electrical biasing source coupled to said pre-transfer guide member.

15. The apparatus of claim 14, wherein said post-transfer guide means comprises:

an electrically conductive post-transfer guide member; and an electrical biasing source coupled to said post-transfer guide member.

16. The electrostatographic printing machine of claim 15, further comprising a variable electrical biasing means coupled to said transfer means, for electrically biasing said transfer means to a polarity opposite the polarity of said charged toner particles.

17. The electrostatographic printing machine of claim 16, further including a constant current source, coupled to said variable electrical biasing means, for providing a constant current signal thereto.

18. The electrostatographic printing machine of claim 15, wherein said transfer means includes a bias transfer roll.

19. The electrostatographic printing machine of claim 15, wherein said transfer means includes a corona generating device.

20. The electrostatographic printing machine of claim 15, wherein said post-transfer sheet guide means includes an electrically conductive flexible brush.

21. The electrostatographic printing machine of claim 15, wherein said post-transfer guide means includes a vacuum transport device.

22. The electrostatographic printing machine of claim 15, wherein said pre-transfer guide means includes an electrically conductive baffle.

23. The electrostatographic printing machine of claim 15, wherein said pre-transfer guide means includes means, coupled to said electrically conductive pre-transfer guide member, for providing selective mechanical engagement of said pre-transfer guide member against the copy substrate to induce intimate physical contact between the copy substrate and the image support surface in the pre-transfer zone.

24. The electrostatographic printing machine of claim 15, wherein said post-transfer guide means includes means, coupled to said electrically conductive post-transfer guide member, for providing selective mechanical engagement of said post-transfer guide member against the copy substrate to induce intimate physical contact between the copy substrate and the image support surface in the post-transfer zone.

* * * * *